US008146313B2

(12) United States Patent
Proot et al.

(10) Patent No.: US 8,146,313 B2
(45) Date of Patent: Apr. 3, 2012

(54) MULTIFUNCTION FINISHING ASSEMBLY FOR FLOOR COVERING, A METHOD FOR MANUFACTURING AND A METHOD FOR LAYING SAID ASSEMBLY

(75) Inventors: Bernard Proot, Marcq en Baroeul (FR); Jacques Desmet, Zandvoorde (BE)

(73) Assignee: Depro France, Armentieres (FR)

( * ) Notice: Subject to any disclaimer, the term of this patent is extended or adjusted under 35 U.S.C. 154(b) by 949 days.

(21) Appl. No.: 11/795,369

(22) PCT Filed: Jan. 17, 2006

(86) PCT No.: PCT/EP2006/000362

§ 371 (c)(1),
(2), (4) Date: Jul. 16, 2007

(87) PCT Pub. No.: WO2006/079468

PCT Pub. Date: Aug. 3, 2006

(65) Prior Publication Data

US 2009/0120262 A1 May 14, 2009

(30) Foreign Application Priority Data

Jan. 25, 2005 (FR) ..... 05 00736
Jan. 25, 2005 (FR) ..... 05 00739

(51) Int. Cl.
*E04B 1/68* (2006.01)

(52) U.S. Cl. ..... 52/464; 52/466; 52/468; 52/716.2

(58) Field of Classification Search ..... 52/716.3, 52/716.4, 717.01, 718.01, 464, 466, 468, 52/716.2

See application file for complete search history.

(56) References Cited

U.S. PATENT DOCUMENTS

| | | | | |
|---|---|---|---|---|
| 3,696,461 | A * | 10/1972 | Kelly | 16/16 |
| 5,657,598 | A * | 8/1997 | Wilbs et al. | 52/287.1 |
| 6,321,454 | B1 | 11/2001 | Wass et al. | |
| 6,523,986 | B1 | 2/2003 | Hoffmann et al. | |
| 6,536,178 | B1 * | 3/2003 | P.ang.lsson et al. | 52/589.1 |
| 6,591,568 | B1 * | 7/2003 | P.ang.lsson | 52/592.2 |
| 6,823,638 | B2 * | 11/2004 | Stanchfield | 52/588.1 |
| 6,860,074 | B2 * | 3/2005 | Stanchfield | 52/464 |
| 7,207,143 | B2 * | 4/2007 | Stanchfield | 52/459 |
| D542,939 | S * | 5/2007 | Neuhofer, Jr. | D25/136 |
| D542,941 | S * | 5/2007 | Neuhofer, Jr. | D25/136 |
| 7,287,357 | B2 * | 10/2007 | Gomez Insa | 52/464 |
| 7,296,387 | B2 * | 11/2007 | Milu | 52/716.4 |
| 2003/0084634 | A1 * | 5/2003 | Stanchfield | 52/464 |
| 2003/0118812 | A1 * | 6/2003 | Kornfalt et al. | 428/331 |
| 2003/0154678 | A1 * | 8/2003 | Stanchfield | 52/468 |
| 2003/0159389 | A1 * | 8/2003 | Kornfalt et al. | 52/396.04 |
| 2004/0206038 | A1 * | 10/2004 | Stanchfield | 52/582.1 |
| 2005/0003149 | A1 * | 1/2005 | Kornfalt et al. | 428/120 |
| 2006/0150565 | A1 * | 7/2006 | Schacht et al. | 52/716.1 |

FOREIGN PATENT DOCUMENTS

DE 36 00 318 A1 7/1987

(Continued)

*Primary Examiner* — William Gilbert
*Assistant Examiner* — Alp Akbasli
(74) *Attorney, Agent, or Firm* — Harness, Dickey & Pierce, P.L.C.

(57) ABSTRACT

The finishing assembly for floor covering comprises at least two bars (1;2/1;3), being on the one hand assembled together side by side such that they comprise at least two surfaces (1*d*;2*d*/1*d*; 3*d*) substantially in the prolongation of one another, and separated by a longitudinal interstice (6/6'), and being, on the other hand, separable. Both assembled bars (1;2/1;3) are designed to be used in a first floor covering application and at least one (1) of said two bars are designed to be used in a second floor covering application. The assembly further comprises a surface coating (4) being applied on both bars (1;2/1;3) and covering the longitudinal interstice (6/6') between both bars.

18 Claims, 12 Drawing Sheets

FOREIGN PATENT DOCUMENTS

| | | | | |
|---|---|---|---|---|
| DE | 37 07 045 | A1 | | 9/1988 |
| DE | 198 00 517 | C1 | | 8/1999 |
| EP | 0 092 040 | A1 | | 10/1983 |
| EP | 1 493 880 | A2 | | 1/2005 |
| JP | 2000-210909 | A | | 8/2000 |
| WO | WO-00/14351 | A1 | | 3/2000 |
| WO | WO-01/86091 | A1 | | 11/2001 |
| WO | WO 2005083195 | A1 | * | 9/2005 |
| WO | WO2005083196 | | * | 9/2005 |
| WO | WO-2006/074824 | A2 | | 7/2006 |

* cited by examiner

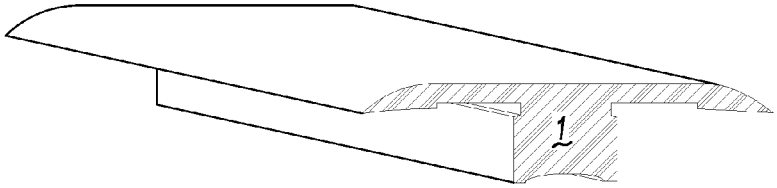
Fig-2 (Step 1)
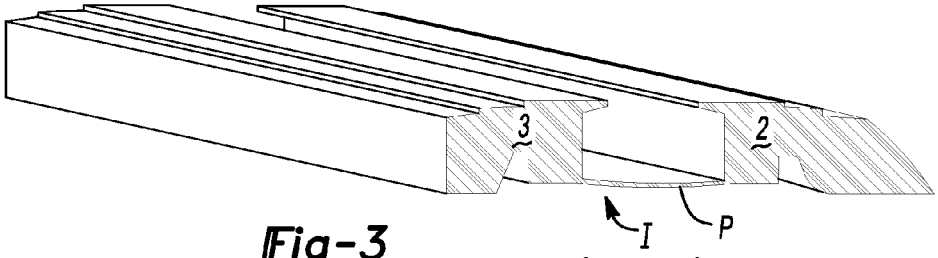
Fig-3 (Step 1)
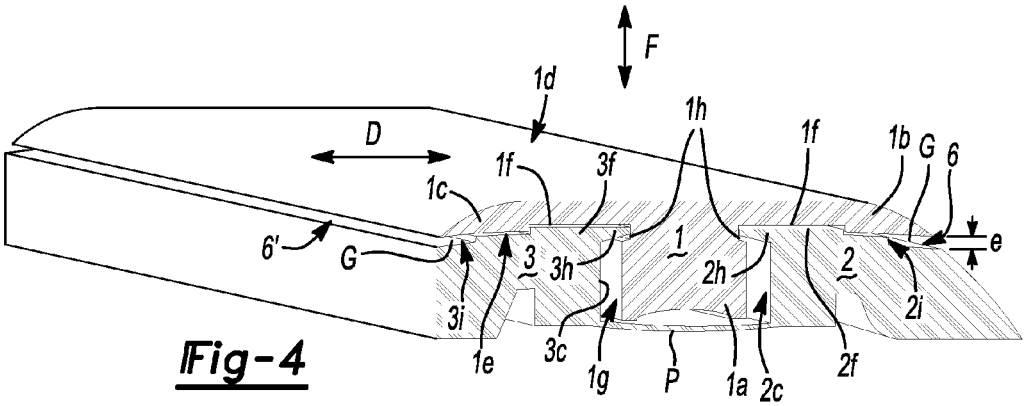
Fig-4 (Step 2)

(Step 3 & 4)

(Step 4)

(Step 5)

MULTIFUNCTION FINISHING ASSEMBLY FOR FLOOR COVERING, A METHOD FOR MANUFACTURING AND A METHOD FOR LAYING SAID ASSEMBLY

CROSS-REFERENCE TO RELATED APPLICATIONS

This application is a U.S. National Stage Application of International Application No. PCT/EP2006/000362, filed Jan. 17, 2006 and published in English as WO 2006/079468 A1 on Aug. 3, 2006. This application claims the benefit of FR Application Nos. 0500736, filed Jan. 25, 2005, and 0500739, filed Jan. 25, 2005. The disclosure(s) of the above applications are incorporated herein by reference.

TECHNICAL FIELD

The present invention relates to a multifunction finishing assembly for floor covering, which could be used in at least two different applications, and preferably either as a joint bar between two floor coverings or transition bar, or as a joint bar between two floor coverings or stop bar, or as a joint bar between two floor coverings or transition bar or stop bar.

PRIOR ART

In the field of floor covering laying or renovation or floor renovation, it is of common practice to use finishing elements in the form of finishing bars, for example, made of wood, metal or plastic, to be fixed to the floor, so as to cover the edge of at least one floor covering. Amongst such finishing elements there are predominantly joint bars, transition bars, stop bars and step ridges. The application for the finishing bar (joint bar, transition bar, stop bar or step ridge) is determined depending on its cross-sectional profile.

Finishing elements for floor covering of the joint bar, transition bar, stop bar or step ridge type are disclosed, for example, in patent applications US2003/0154678 and US2004/0206038, and in U.S. Pat. Nos. 6,745,534, 6,805,951, 6,517,935, in French Patent Applications FR 2,737,237, FR 2,848,234, FR 2,695,671, FR 2,783,854 and in International Patent Application WO 03/040492.

As used herein, the term "joint" bar refers to a bar to be laid on the floor at the interface between two adjacent floor coverings (moquette, carpet, parquet, wooden floor, floor tiles, . . . ). Such a bar type generally has a T-shaped cross-sectional profile. Each T wing is used for covering the edge of one of both coverings and the T foot is used for fixing the bar to the floor, for example by cooperation with a fixing rail or similar permanently secured between both coverings. Thus, the joint bar allows for the joint to be masked between both floor coverings and for a better aesthetics to be given to the transition zone between both floor coverings. Moreover, the joint bar makes it possible, as required, to compensate for and to mask slight thickness differences between both floor coverings.

As used herein, the term "transition" bar refers to a bar being generally used for providing the transition between a floor covering (moquette, carpet, parquet, wooden floor, floor tiles, . . . ) and the floor or between two floor coverings with a significant height offset. The function thereof is therefore to compensate for and to mask significant height differences between a floor covering and the floor or between two floor coverings.

As used herein, the term "stop" bar refers to a bar generally ending at the opposite side of the floor covering with a substantially vertical side. Such a bar type is generally used as a finishing element between a floor covering and a vertical wall such as a wall or a partition.

The "step ridges" are bars having a L-shaped cross-sectional profile and being intended for being fitted on a step angle.

For improving the aesthetics and/or wear resistance of floor covering finishing bars, it is additionally known to apply on such bars, when being manufactured, a surface coating which is, for example, a film or a sheet of material glued with the top surface of the bar. By way of an example, the above-mentioned U.S. Pat. Nos. 6,805,951 and 6,517,935 describe a method for manufacturing a finishing element comprising a thin abrasion-resistant coating being of the multilayer type.

More particularly with a view to simplify the supply management and to offer to the customers a single multiuse product, the finishing bar manufacturers focussed these recent years on the manufacture and marketing of multifunction finishing bar assemblies of the kit type. A multifunction finishing assembly is described for example in International Patent Application WO 03/040492. In said Publication, the multifunction finishing assembly comprises a T-shaped joint bar onto which an additional side bar is embedded. When the additional side bar is assembled with the T-shaped element, the assembly can be used as a transition bar ($1^{st}$ application). For using the assembly as a joint bar ($2^{nd}$ application), it is sufficient to separate the additional bar from the T-shaped bar, the latter being able to be used as a joint bar.

One drawback of multifunction finishing assemblies as known currently lies in the presence of a small width longitudinal gap (interstice) at the junction of the surfaces of the individual bars making up the assembly. Not only does such a gap ruin the aesthetic quality of the finishing assembly, but it also deleteriously results in a brittleness area that could be easily damaged over time and that gets dirty more easily.

OBJECTIVE OF THE INVENTION

The objective of the present invention is to provide a finishing assembly for floor covering being of the multifunction type and overcoming the above-mentioned drawback related to the presence of an interstitial joint between each individual element of the multifunction assembly.

SUMMARY OF THE INVENTION

Such an objective is achieved by the finishing assembly for floor covering as claimed in claim 1. As known, in the above-mentioned Publication WO 03/040492, such a finishing assembly comprises at least two bars, being on the one hand assembled together side by side so that they comprise at least two surfaces substantially in the prolongation of one another, and separated by a longitudinal interstice, and being, on the other hand, separable, said assembled bars being designed to be used in a first floor covering application and at least one of said bars being designed to be used in a second floor covering application.

In a characteristic and novel way according to the invention, the finishing assembly comprises a floor covering being applied on said assembled bars and covering the longitudinal interstice between said bars.

More particularly, the multifunction assembly according to the invention comprises the additional and optional technical features such as defined in the appended claims and depending on the main claim 1, said technical features being, depending on the case, considered separately or in combination one with the others.

According to a another aspect of the invention, the multifunction finishing assembly for floor covering according to the invention comprises a central bar having a substantially T-shaped cross section, a monobloc assembly comprising two side bars being connected together by a bridge and being individually separable from the monobloc assembly, the T-shaped central bar being embedded into the monobloc assembly such that the foot of said T-shaped central bar is positioned between both side bars and both wings of the T-shaped bar abutting against both side bars. In such a case, the finishing assembly preferably comprises, but not necessarily, a surface coating being applied on all the bars.

More particularly, the multifunction assembly according to the invention comprises the following additional and optional features considered separately or in combination one with the others:

- the finishing assembly comprises at least a fixing rail able to cooperate with the T-shaped central bar foot; more particularly, such a rail is mounted integrally with the monobloc assembly, and preferably, serves as a bridge connecting both side bars together; and
- the monobloc assembly is an extruded section.

A second object of the invention is a method for manufacturing the above-mentioned finishing assembly. According to the invention, such a method of manufacturing comprises the following steps:

- manufacturing at least two distinct bars with the same length;
- assembling said bars side by side such that they have two surfaces substantially in the prolongation one of the other and separated by a longitudinal interstice; and
- applying on the bars a surface coating covering the longitudinal interstice.

Preferably, during the manufacture, the bars are temporarily maintained together for enabling the application of the surface coating without moving the bars one in respect to the other. More particularly, when the method is related to the manufacture of a finishing assembly comprising one central bar and two side bars, an intermediate element is being manufactured, said intermediate element consisting of both side bars being connected together by a temporary bridge.

Also, in a particular alternative of the invention, a movable support pedestal is temporarily assembled with the bars, said pedestal allowing to temporarily block said bars together in particular when the assembly is being transported or handled.

A third object of the present invention is to provide a method for laying onto the floor a multifunction finishing assembly.

According to the invention, such a method comprises a step wherein the surface coating is being cut at the level of at least one longitudinal interstice between two bars of the finishing assembly so as to separate said both bars.

A fourth object of the invention is a cutting tool comprising a shoe and a cutting blade being integral with the shoe. The shoe is designed to be positioned on the finishing assembly and to be able to slide along such a finishing assembly while being guided in translation by at least one side bar of said assembly. The cutting blade is positioned and oriented relative to such a shoe, such that once the shoe positioned on the finishing assembly, the cutting blade allows the surface coating to be cut through translation of the shoe along the finishing assembly.

BRIEF DESCRIPTION OF THE DRAWINGS

Other features and advantages of the invention will be more clearly apparent on reading the herein below detailed description of several preferred alternative finishing assemblies according to the invention, such a description being set forth as a non limitative and non exhaustive example of the invention and referring to the appended drawings wherein:

FIG. 2 is a perspective view of the T-shaped central bar of the assembly as shown on FIG. 1, FIG. 3 is a perspective view of an intermediate section comprising both side bars of the assembly as shown on FIG. 1, connected by a separable temporary bridge, FIG. 4 is a perspective view of the T-shaped central bar of FIG. 2 assembled with the intermediate section as shown on FIG. 3.

DETAILED DESCRIPTION

Figure 1:
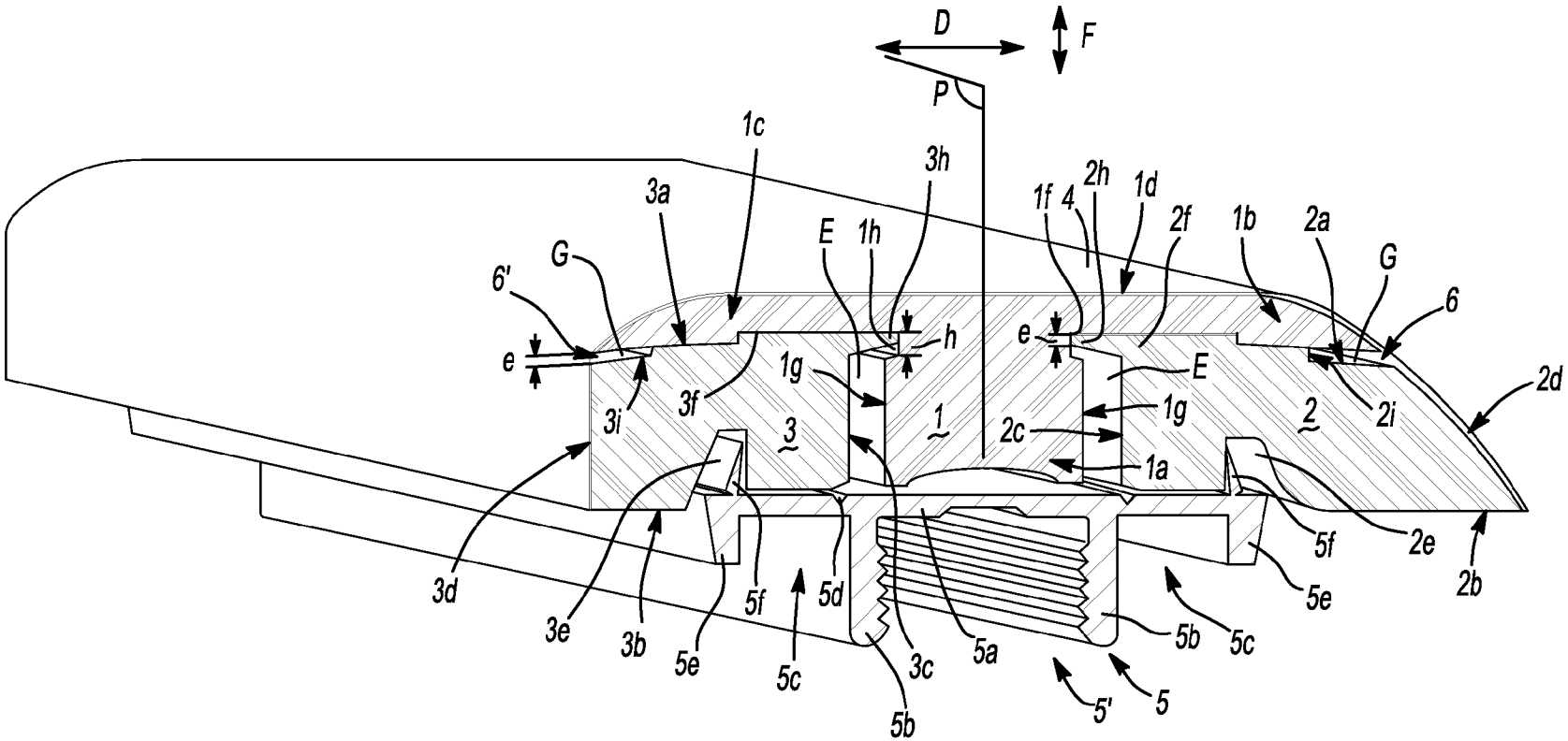
FIG. 1 is a perspective view of a first alternative embodiment of a multifunction finishing assembly (joint bar/transition bar/stop bar) comprising a section forming a movable pedestal temporarily connecting the side bars of the multifunction assembly and additionally comprising a U-shaped fixing rail.

On FIG. 1 there is shown a finishing assembly for a floor covering according to a first preferred embodiment of the invention, and which could be used in three different applications either as a joint bar, a transition bar or a stop bar.

Such a finishing assembly consists in five elements:

- three finishing bars, with the same length, and for example, made of wood, namely a central bar 1, and two side bars 2 and 3 arranged on both sides of the central bar,
- a surface coating 4 applied onto the three finishing bars 1, 2 and 3, and
- a pedestal 5, for example, in plastic.

The two side bars 2 and 3 have different cross-sectional profiles (i.e., in a plane perpendicular to their longitudinal axis).

When being used on its own, the finishing bar 1 is a joint bar ($1^{st}$ application). Both bars 1 and 2, when they are used together, form a transition bar ($2^{nd}$ application). Both bars 1 and 2, when being used together, form a stop bar ($3^{rd}$ application).

In particular, in the illustrated example, the joint bar 1 is symmetrical according to a median longitudinal plane (P) and has a T-shaped cross section, with a central pedestal 1*a*, and two side wings 1*b* and 1*c* being identical and symmetrical with one another relative to the plane P. The bar 1 comprises a top surface 1*d* being planar in its central part and having a circle arc-shaped curve at the level of both wing 1*b* and 1*c* ends.

The side bar 2 is a distinct part of the above-mentioned bar 1 and is positioned side by side with the bar 1 between the central foot 1*a* and the wing 1*b*. The bar 2 comprises a top face 2*a*, being partially in contact with the bottom face of the wing 1*b*, a bottom face 2*b*, an internal side face 2*c* directed to the central foot 1*a* of the bar 1 and a slightly curve external side face 2*d*. The external side face 2*d* of the bar 2 lies in the extension of the top face 1*d* of the central bar 1, a longitudinal interstice 6 separating both faces 1*d* and 2*d* throughout the length of the bars 1 and 2.

The bar 3 is a part distinct from the above-mentioned bar 1 and is positioned side by side with the bar 1 between the central foot 1*a* and the wing 1*c*. The bar 3 comprises a top face 3*a*, partially coming in contact with the internal face of the wing 1*b*, a bottom face 3*b*, an internal side face 2*c* directed toward the central foot 1*a* of the bar 1, and an external side face 3*d* being substantially planar and perpendicularly directed toward the planar central part of the top face 1*d* of the bar 1. The external side face 3*d* of the bar 2 lies in the prolongation of the top face 1*d* of the central bar 1, a longitudinal interstice 6' separating both faces 1*d* and 3*d* throughout the length of the bars 1 and 3.

The surface coating 4 is a flexible rectangular-shaped sheet of material (monolayer or multilayer), being applied and fixed through any known means and for example, through gluing by means of an adhesive, on the top face 1*d* of the bar 1 and on the external side faces 2*d* and 3*d* respectively of the bars 2 and 3. The surface coating 4 covers all the above-mentioned surfaces 1*d*, 2*d*, and 3*d*, and essentially covers and masks advantageously the two longitudinal interstices 6 and 6'. The three bars 1, 2 and 3 are thus retained together through such a surface coating 4.

More generally, within the scope of the invention, the "surface coating" of the finishing assembly may comprise any coating having a thin thickness being able to match the curved surface of the individual bars on the finishing assembly, whatever the nature of the material(s) making up the coating and whatever the technique used for applying the coating on the bars of the finishing assembly. In particular, the coating could indiscriminately be of the monolayer or of the multilayer type. It could for example comprise a film or a sheet, made in plastic, in paper, in wood, or be made in any known fabric (non woven, woven fabric). Preferably, but not necessarily, the coating will be decorative and/or will have improved mechanical wear resistant properties. Preferably, but not necessarily, the surface coating is glued (cold or heat glued) on the bars of the finishing assembly.

The pedestal 5 is a section, preferably made in plastic, with the same length as the bars 1, 2 and 3. It comprises a base plate 5*a* and two identical, parallel longitudinal walls 5*b*, substantially perpendicular to the base plate 5*a*. Those both walls 5*b* form together with the base plate 5*a*, a U-shaped rail 5', for fixing on the floor the bar(s) of the finishing assembly.

In the particular alternative embodiment of FIG. 1, the pedestal 5 further comprises two side wings 5*c* extending the base plate 5*a* on both sides of the U-shaped fixing rail 5'. Each side wing 5*c* is separable relative to the U-shaped rail 5'. Preferably, in order to facilitate the separation through cutting each side wing 5*c*, a V-shaped longitudinal groove 5*d* is provided at each joint between the U-shaped fixing rail 5' and each side wing 5*c*, said V-shaped groove 5*d* making up a separation line with a lower thickness.

More particularly, both side bars 2 and 3 comprise respectively in the lower sides 2*b*, 3*b* thereof two longitudinal grooves 2*e* and 3*e*. Each side wing 5*c* of the pedestal 5 ends at a longitudinal retaining stud 5*e* being designed to be embedded, preferably by tightening, into one of the grooves 2*e* or 3*e*.

More particularly, each wing 5*c* of the pedestal 5 comprises an additional longitudinal stud 5*f* being separable. Referring to FIG. 1, the additional studs 5*f* are housed into the two above-mentioned longitudinal grooves 2*e* and 3*e*, such that the pedestal 5 is temporarily assembled with the two side bars 2 and 3. Preferably, both studs 5*f* are slightly resiliently flexible relative to the base plate 5*a*, such that the pedestal 5 is made integral through nipping of the bars 1, 2 and 3 between both temporary studs 5*f*.

In the embodiment on FIG. 1, the pedestal 5 advantageously makes it possible to block in position the side bars 2 and 3 abutting against the bar 1, and more particularly prevents the side bars 2 and 3 from moving relative to the side bar 1 in a plane parallel to the cross-section of the bars. The assembly 1, 2, 3, 4 and 5 thus makes up a ready-to-use multifunction finishing assembly, able to be advantageously easily handled and/or transported and/or offered for sale. When being offered for sale, such an assembly could be obviously wrapped with the user's guide, in a transparent plastic wrap.

In particular, in the alternative embodiment shown on FIG. 1, the bottom face 1*e* of each wing 1*b* and 1*c* of the central bar 1 comprises a blocking longitudinal groove 1*f* forming a double abutment, into which is positioned a projecting longitudinal part 2*f* or 3*f* of the bar 2 or 3. Said projecting part 2*f* or 3*f* allows to laterally block in translation the side bar 2 or 3 relative to the central bar 1 following an axis D perpendicular to the median longitudinal plane P of the bar 1.

Preferably, the side faces 1*g* of the central foot 1*a* of the bar 1 comprise a longitudinal groove 1*h* forming a double abutment, into which is to be arranged a projecting longitudinal part 2*h* (respectively 3*h*) of the bar 2 (respectively the bar 3), allowing the bar 2 (respectively the bar 3) to be blocked in translation relative to the foot 1*a* of the bar 1 in a plane parallel to its cross sectional section and along an axis F perpendicular to the above-mentioned axis D.

Preferably, the thickness (e) of the projecting longitudinal part 2*h* (respectively 3*h*) of the bar 2 (respectively the bar 3) is lower than the height (h) of the groove 1*h* such that there should be, between the bar 2 (respectively the bar 3) and the bar 1, a slight play advantageously allowing for a slight motion of the bar 2 (respectively bar 3) relative to the bar 1 in a plane parallel to the cross-section of the bars. The utility of such a clearance will be more clearly obvious referring to FIG. 26.

Advantageously, the projecting longitudinal parts 2*h* and 3*h* allow on both sides of the foot 1*a* of the central bar 1, for providing a longitudinal space E being able to serve as a housing for the walls 5*b* of the fixing rail 5' of the pedestal 5.

According to an additional preferred feature, the side bar 2 (respectively the side bar 3) comprises a longitudinal recess 2*i* (respectively 3*i*) extended throughout the length of the bar and being arranged opposite to the bottom face of the wing 1*b* (respectively wing 1*c*) of the bar 1. Such a recess 2*i* (respectively 3*i*) delimits with the bottom face of the wing 1*b* (respectively wing 1*c*) of the bar 1, a groove G with a low width (l) allowing a cutting blade to be inserted and guided. The entry of such a groove G corresponds to the interstice 6 or 6'. Practically, the width (l) of the groove will be preferably higher than 0.6 mm.

FIG. 2 to 7 illustrate the main successive steps for manufacturing the finishing assembly of FIG. 1.

Step 1 (FIGS. 2 and 3)

The joint bar 1 and the intermediate part I are manufactured with two bars 2 and 3 connected throughout their length by a separable temporary longitudinal bridge P. Depending on the material type, such parts 1 and I are manufactured, for example, through machining (wooden parts) or through extrusion (plastic or metal parts).

Step 2 (FIG. 4)

Through a simple embedment, the bar 1 is interfitted with the intermediate part I, the foot 1*a* of the bar 1 being housed into the longitudinal space delimited by both external side faces 2*c* and 3*c* opposite the bars 2 and 3 and by the temporary bridge P. During this assembling operation, the projecting parts 2*f* and 3*f* of the bars 2 and 3 are housed in the corresponding grooves 1*f* of the bar 1, allowing the bar 2/bar 3/temporary bridge P assembly to be centred relative to the bar 1. As a result, the bars 2 and 3 are perfectly positioned and maintained in position relative to the bar 1 during the subsequent application operation of the surface coating 4 (Step 3/FIG. 5).

Figure 5:
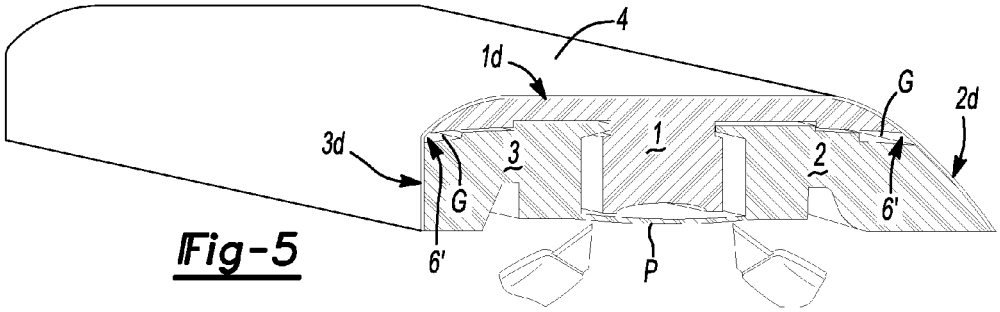
FIG. 5 is a perspective view of the assembly as shown on FIG. 4 after application of the surface coating onto the bars.

Step 3 (FIG. 5)

The surface coating 4 is applied and glued on the assembly formed by the parts 1 and I, so as to totally cover the faces 1*d*, 2*d* and 3*d* of the bars 1, 2 and 3. The application and gluing technique of such a coating is known per se and will therefore not be detailed in the present application. The temporary bridge P advantageously makes it possible to maintain the bars 2 and 3 relative to the bar 1 during the application operation of the surface coating 4.

Once applied, the surface coating 4 advantageously masks both interstices 6 and 6'.

Figure 6:
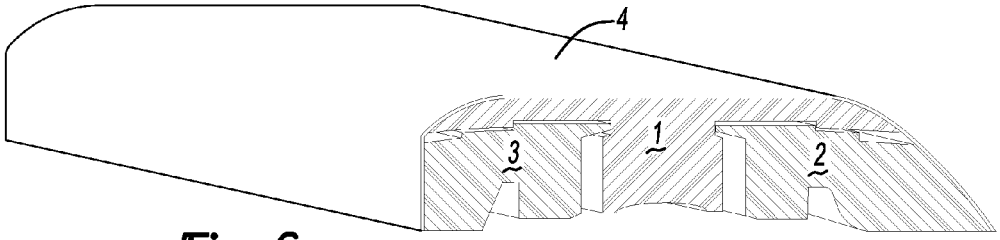
FIG. 6 is a perspective view of the assembly shown on FIG. 5 after cutting the temporary bridge connecting the side bars.

Step 4 (FIGS. 5 and 6)

The temporary bridge P connecting the bars 2 and 3 is removed by cutting it using a cutting tool (for example, a cutting blade (FIG. 5) or a saw), so that the bars 2 and 3 are no longer directly integral with one another (FIG. 6). The bars 1, 2 and 3 are maintained together by the surface coating 4.

Figure 7:
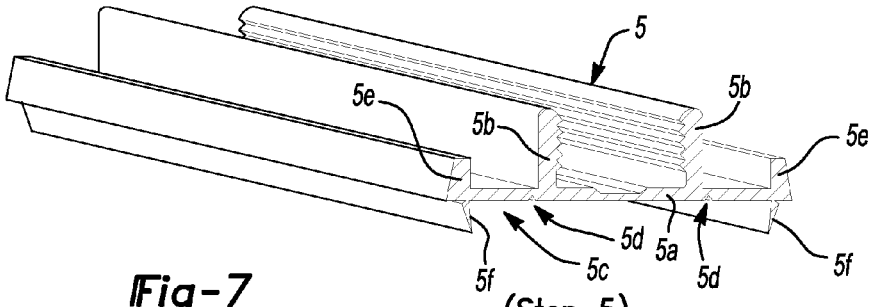
FIG. 7 is a perspective view of the pedestal of the multifunction assembly as shown on FIG. 1, FIGS. 8, 9 and 10 show applications of the multifunction assembly shown on FIG. 1 respectively as a joint bar, a transition bar and a stop bar.

Step 5 (FIGS. 7 and 1)

The pedestal 5, being previously manufactured (FIG. 7) for example through extrusion, is assembled with the previously formed bar 1/bar 2/bar 3/coating 4 assembly, so as to form the finishing assembly as shown on FIG. 1. Such an assembly operation could be simply achieved embedding or interfitting the side bars 2 and 3 onto separable temporary studs 5*f* of the pedestal 5. In such a configuration of FIG. 1, the pedestal 5 advantageously allows the above-mentioned temporary bridge P to be replaced, mechanically connecting both bars 2 and 3 together, and maintaining them applied on the central bar 1. The finishing assembly shown on FIG. 1 could thus be handled without risking to move the bar 2 or the bar 3 relative to the bar 1 and thereby without risking to damage the coating 4.

Figure 8:
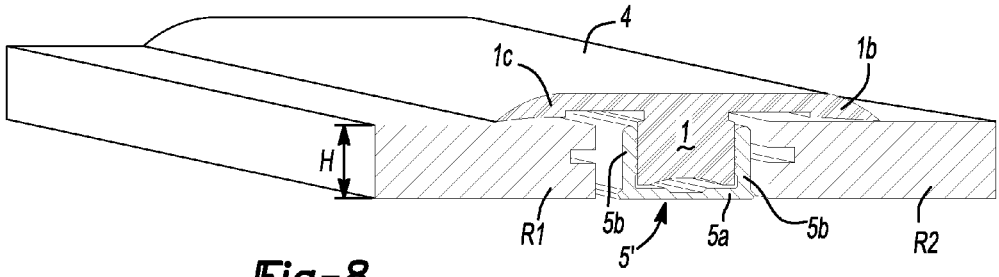
Figure 9:
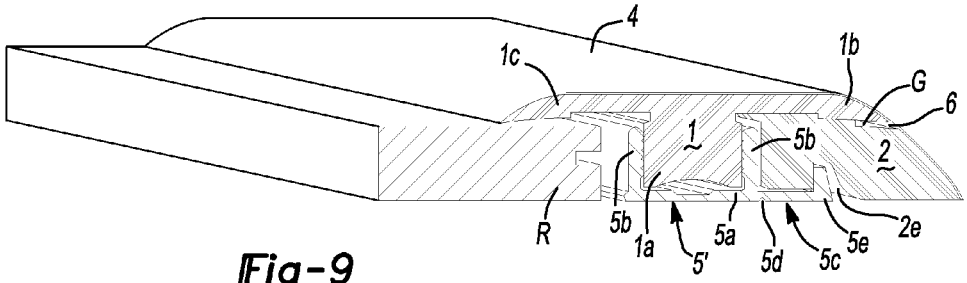
Figure 10:
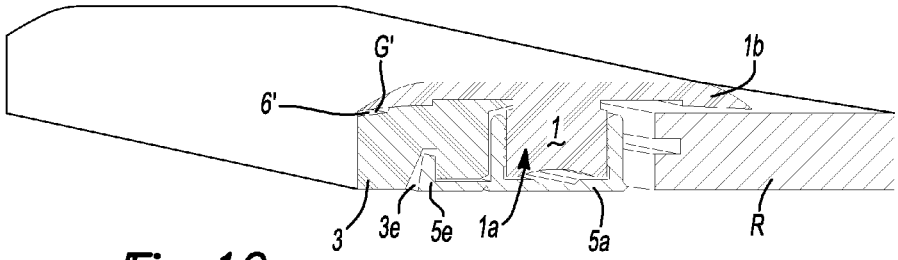

The various usage possibilities of the finishing assembly according to FIG. 1 will now be detailed referring to FIGS. 8 to 10.

Use as a Joint Bar (FIG. 8)

On FIG. 8 there is shown the implementation of the central bar 1 of the assembly as in FIG. 1 as a joint bar, interposed between both floor coverings R1 and R2 having substantially the same height H relative to the floor. It could be any known type of floor covering (wooden floor, moquette, carpet, parquet, wooden floor, floor tiles, linoleum, . . . ). In order to achieve the implementation of FIG. 8, it is sufficient for the final user having the finishing assembly shown on FIG. 1 to perform the following operations.

The pedestal 5 is released from the bars 2 and 3 of the finishing assembly. The pedestal 5 is cut along both V-shaped grooves 5*d* so as to only keep the U-shaped fixing rail 5'. The coating 4 is cut using a blade or similar, along each longitudinal groove G, so as to separate the side bars 2 and 3 (and their surface coating 4 portion), from the central bar 1 and its surface coating 4 portion. The width (l) of each interstice 6, 6' being sufficient for sliding a cutting blade into the groove G, advantageously a sharp cutting of the coating 4 is achieved.

Subsequently, the base 5*a* of the U-shaped fixing rail 5' is fixed to the floor between both coverings R1 and R2, using any appropriate means selected more specially depending on the nature of the floor (for example, screwing and/or gluing). The central foot 1*a* of the bar 1 is inserted into both arms 5*b* of the rail 5' and pushing it until both wings 1*b* and 1 of the bar come into contact with the surface of both coverings R1, R2. Preferably, the internal side of both arms 5*b* is notched so as to allow the joint bar 1 to be blocked in position at different heights, depending on the height H of the coverings.

Use as a Transition Bar (FIG. 9)

There is shown on FIG. 9, the implementation of the finishing assembly of FIG. 1 as a transition bar between a floor covering R and the floor underlying such a floor covering. In order to achieve the implementation of FIG. 9, it is sufficient for the final user having the finishing assembly shown on FIG. 1 to perform the following operations.

The pedestal 5 is released from the bars 2 and 3 of the finishing assembly. The pedestal 5 is cut manually along one of the V-shaped grooves 5*d* so as to only keep the U-shaped fixing rail 5' and a side wing 5*c*, the other side wing 5*c* being removed. The temporary stud 5*f* is cut from the remaining wing 5*c*.

The coating 4 is cut manually using a blade or similar, slid into the groove G, so as to separate the side bar 3 (and its surface coating 4 portion), from the remaining assembly: bar 1/bar 2/coating 4 covering the bars 1 and 2.

Subsequently, the base 5*a* of the U-shaped fixing rail 5' is fixed to the floor along the covering R edge using any appropriate means selected more specially depending on the nature of the floor (for example, screwing and/or gluing).

The foot 1*a* of the central bar 1 is inserted between the U-shaped rail 5' and the longitudinal retaining stud 5*e* into the bottom groove 2*e* of the bar 2. The bar 1/bar 2/coating 4 assembly is pushed until the wing 1*c* of the bar 1 comes into contact with the covering R surface.

Use as a Stop Bar (FIG. 10)

There is shown on FIG. 10 the implementation of the finishing assembly of FIG. 1 as a stop bar between a floor covering R and the floor underlying such a floor covering. In order to achieve the implementation of FIG. 9, it is sufficient for the final user having the finishing assembly shown on FIG. 1 to perform the same operations as previously described for applying the transition bar, but substituting in the explanations bar 3 for bar 2.

Referring to FIG. 9 (transition bar) and to FIG. 10 (stop bar), it is understood that the coating 4 covering the interstitial joint 6 and 6' respectively, it advantageously allows to protect it against any fouling and to mask it, improving the aesthetics of the finishing. In addition, any releasing or damaging risk of the surface coating 4 is prevented at the level of the joint between both bars 1 and 2, or between the bars 1 and 3.

Figure 11:
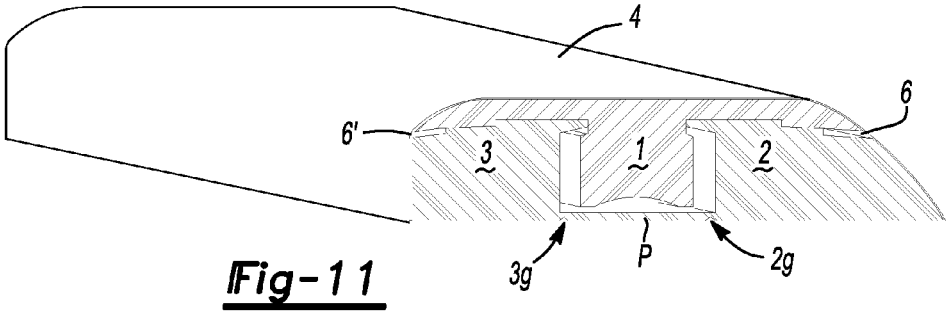
FIG. 11 is a perspective view of a second alternative embodiment of a multifunction finishing assembly (joint bar/transition bar/stop bar)

There is shown on FIG. 11 another further embodiment of the finishing assembly according to the invention, being distinct from the finishing assembly shown on FIG. 1, due to the absence of the pedestal 5 and of the presence of a temporary bridge P connecting between one another both side bars 2 and 3. At the joint between such a bridge and respectively both bars 2 and 3 are arranged V-shaped longitudinal grooves 2*g* and 3*g*. The bridge P is to be used for fixing to the floor, for example, through gluing or screwing, the bar 2 or the bar 3 depending on the selected application (transition bar or stop bar) after the other bar unused in the application has been separated from the bridge P.

Figure 12:
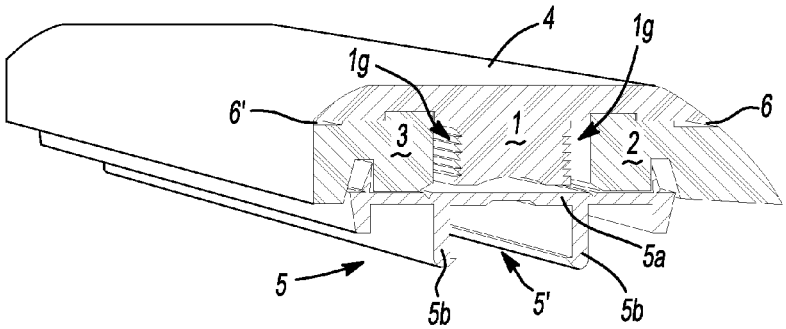
FIG. 12 is a perspective view of a third alternative embodiment of a multifunction finishing assembly (joint bar/transition bar/stop bar)

There is shown on FIG. 12 a third alternative embodiment of a finishing assembly according to the invention. In such an alternative, the side faces 1*g* of the central foot 1*a* of the T-shaped central bar 1 are notched so as to allow the foot 1*a* to be adjusted in height in the U-shaped fixing rail 5'.

Figure 13:
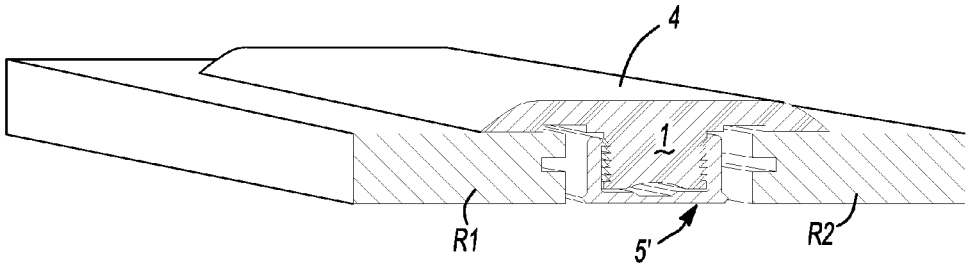
FIGS. 13, 14 and 15 show applications of the multifunction assembly shown on FIG. 12 respectively as a joint bar, a transition bar and a stop bar.
Figure 14:
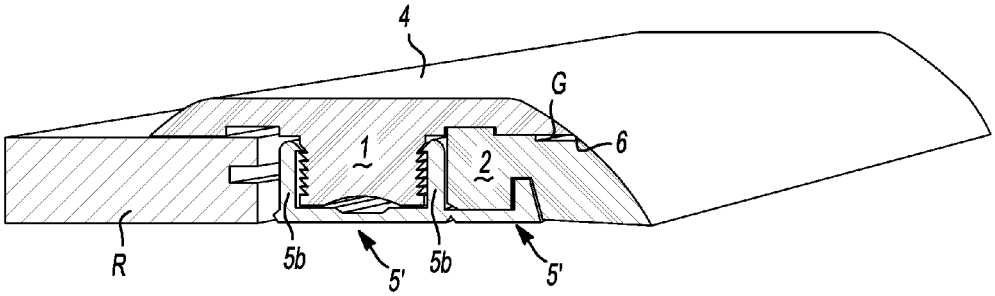
Figure 15:
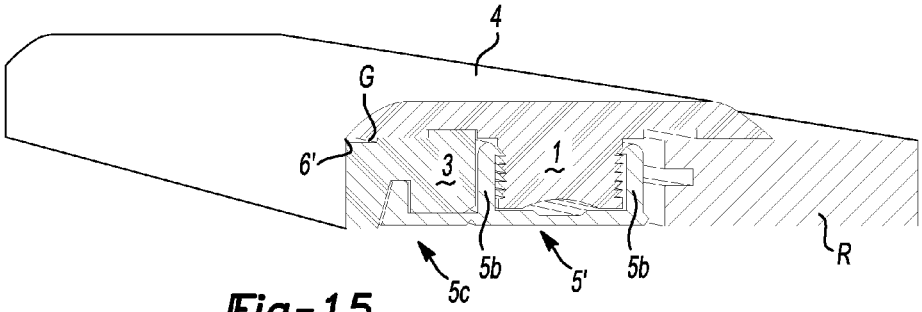

FIGS. 13, 14 and 15 show the finishing assembly of FIG. 12, respectively used as a joint bar, a transition bar and a stop bar.

Figure 16:
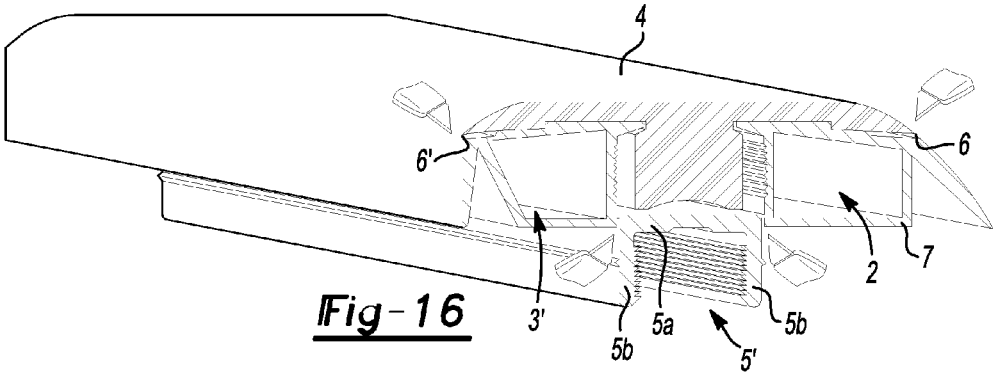
FIG. 16 is a perspective view of a fourth alternative embodiment of a multifunction finishing assembly (joint bar/transition bar/stop bar), FIGS. 17, 18 and 19 shown applications of the multifunction assembly shown on FIG. 16 respectively as a joint bar, a transition bar and a stop bar.

There is shown on FIG. 16 a fourth alternative embodiment of a finishing assembly according to the invention. In such an alternative, the bars 2 and 3 as well as the U-shaped fixing rail 5' are integrally part of a sole monobloc assembly 7. Such a monobloc assembly 7 is preferably a plastic extruded section.

Figure 17:
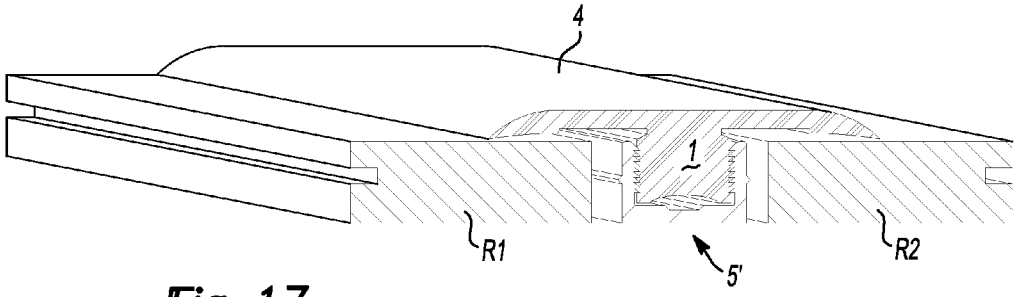
Figure 18:
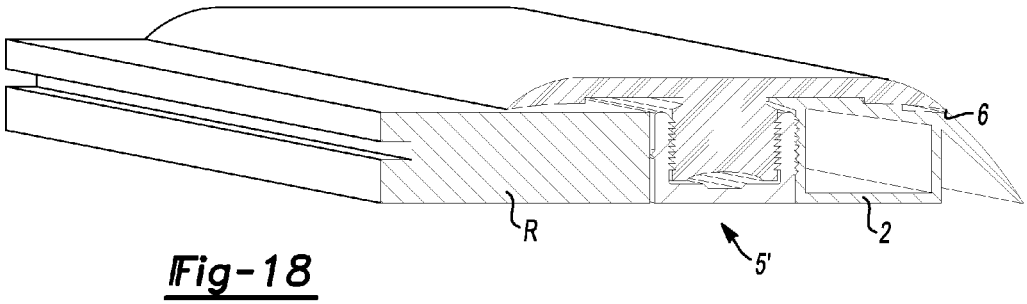
Figure 19:
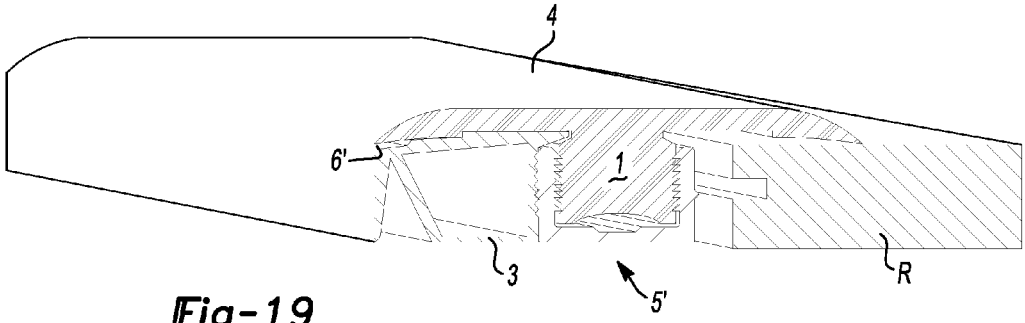

FIGS. 17, 18 and 19 show the finishing assembly of FIG. 16 respectively used as a joint bar, a transition bar and a stop bar. It is to be noted that for FIGS. 18 and 19, the bars 2 and 3 were previously separated through cutting the U-shaped rail 5'.

Figure 20:
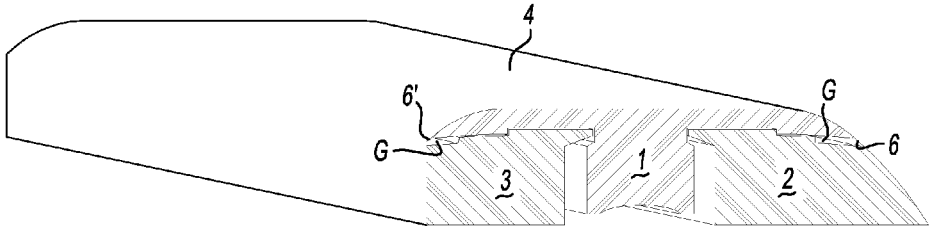
FIG. 20 is a perspective view of a fifth alternative embodiment of the multifunction finishing assembly (joint bar/transition bar/stop bar)
Figure 21:
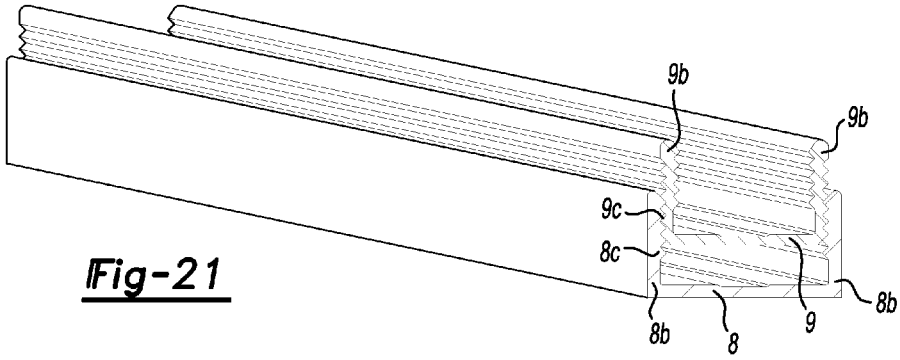
FIG. 21 is a perspective view of two U-shaped fixing rails one embedded into the other and separable, said rails being intended to be used for fixing to the floor the finishing assembly shown on FIG. 20.

There is shown on FIG. 20 a fifth alternative embodiment of a finishing assembly according to the invention, being intended to be used with both U-shaped fixing rails 8 and 9 shown on FIG. 21. The rail 8 is a U-shaped section having its side walls 8*b* notched on their internal faces. The rail 9 is a U-shaped section having its side walls 9*b* notched on their external and internal faces. The rail 9 could additionally be embedded into the rail 8 and adjusted in height relative to the rail 8 in cooperation of its external notches 9*c* with the internal notches 8*c* of the rail 8.

Figure 22:
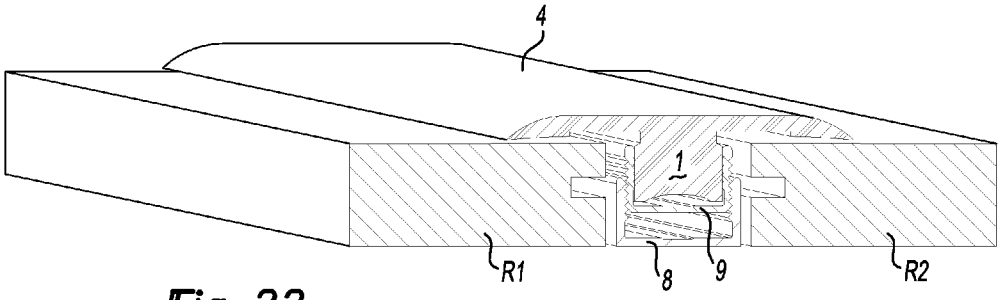
FIG. 22 shows the multifunction assembly shown on FIG. 20 used as a joint bar, FIGS. 23 and 24 respectively show two different applications of the multifunction assembly shown on FIG. 20 as a transition bar, FIGS. 25 and 26 respectively show two different applications of the multifunction assembly shown on FIG. 20 as a stop bar.

FIG. 22 shows the finishing assembly of FIG. 20 configured as a joint bar and fixed to the floor at the joint between both coverings R1 and R2 using both embedded rails of FIG. 21.

Figure 23:
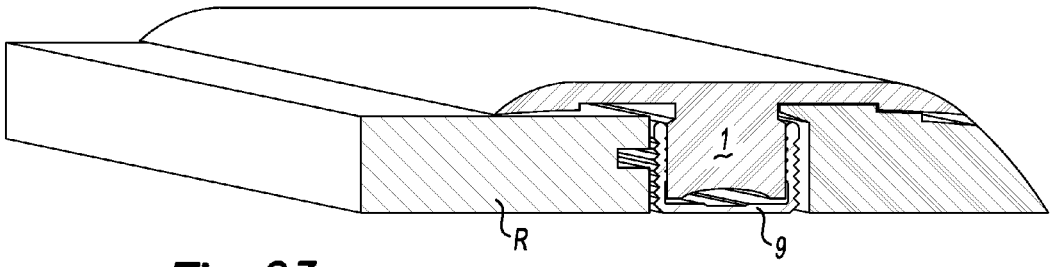

FIG. 23 shows the finishing assembly of FIG. 20 configured as a transition bar and used for a transition between the floor covering R and the floor, said finishing assembly being fixed to the floor by means of the rail 9 only.

Figure 24:
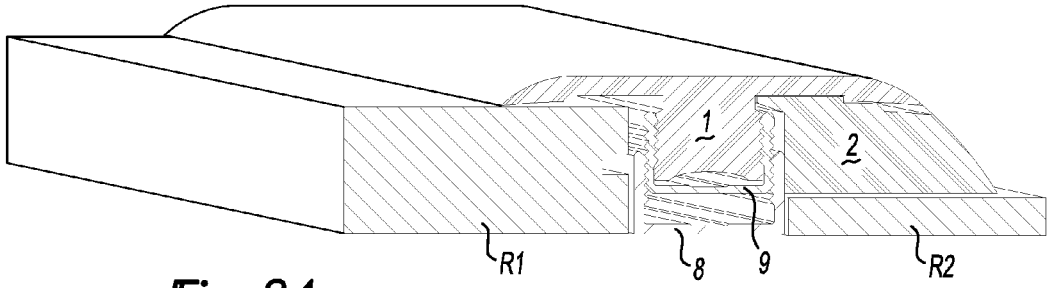

FIG. 24 shows the finishing assembly of FIG. 20 configured as a transition bar and fixed for a transition between both floor coverings R1 and R2 having a significant offset in height one relative to the other. In such an application, the finishing assembly is fixed to the floor by means of both embedded rails 8 and 9.

Figure 25:
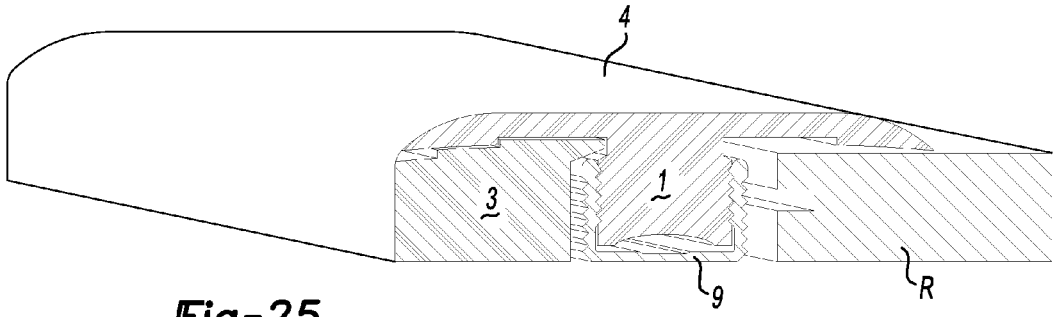

FIG. 25 shows the finishing assembly of FIG. 20 configured as a stop bar and used for a transition between a floor covering R and the floor, said finishing assembly being fixed to the floor by means of the rail 9 only.

Figure 26:
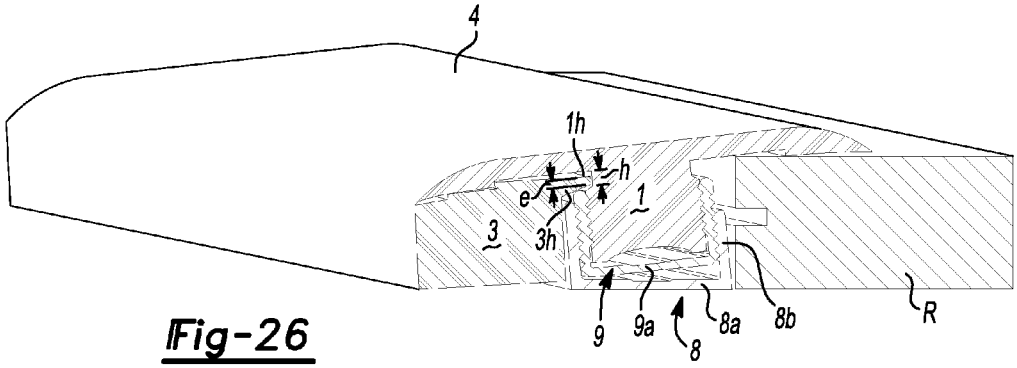

FIG. 26 shows the finishing assembly of FIG. 20 configured as a stop bar and used for a transition between a floor covering R and the floor, said finishing assembly being fixed to the floor by means of both embedded rails 8 and 9. In the application as illustrated on said figure, both rails 8 and 9 are off-centred one relative to the other, the base 9*a* of the rail 9 being not parallel to the base 8*a* of the rail 8 but forming with said base 8*a* an angle A, so as to allow the level to be compensated for between the floor and the covering R. Such a rail 9 tilting relative to the rail 8 is achieved slightly forcibly deforming the side branches 8*b* of the U-shaped rail 8 relative to its base 8*a*. In addition, it is to be noted that in such an embodiment (as well as the alternative embodiments shown on FIG. 1 and on FIG. 16), such a tilting is achievable by means of some play existing between the groove 1*h* and the projecting part 3*h* of the bar 3 (slightly lower dimension (e) at the level (h) of the groove 1*h*), said play allows the bar 3 to be moved relative to the bar 1, in a plane parallel to the cross-section of the bars.

Figure 27:
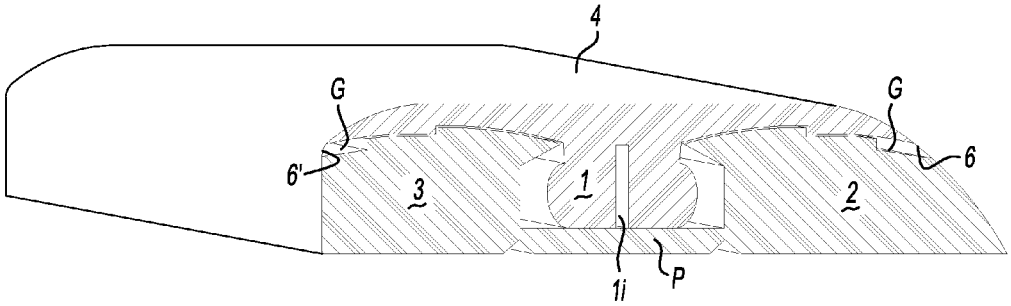
FIG. 27 is a perspective view of a sixth embodiment of a multifunction finishing assembly (joint bar/transition bar/stop bar)
Figure 28:
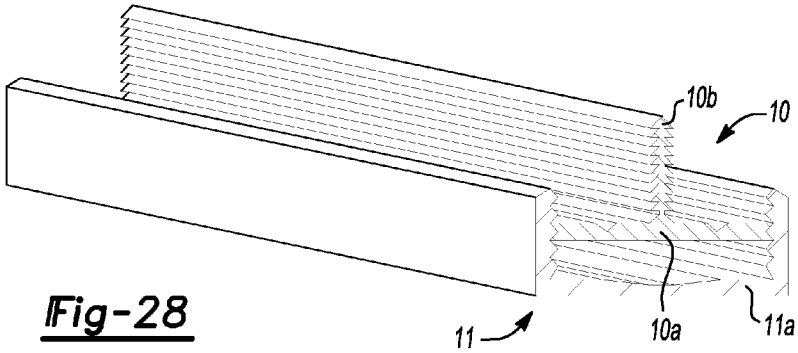
FIG. 28 is a perspective view of two fixing rails respectively with U-shaped and T-shaped, one embedded into the other and separable, said rails being intended to be used for fixing to the floor the finishing assembly shown on FIG. 27, FIGS. 29, 30, and 31 show applications of the multifunction assembly as shown on FIG. 12 respectively as a joint bar, a transition bar and a stop bar.

There is shown on FIG. 27 a sixth alternative embodiment of a finishing assembly according to the invention, being intended to be used with both fixing rails 10 and 11 of FIG. 28.

The rail 11 comprises a U-shaped section. The rail 10 comprises a T-shaped section and can be embedded at various heights into the U-shaped section 11.

In the finishing assembly of FIG. 27, the foot 1*a* of the T-shaped bar 1 comprises a longitudinal groove 1 allowing for said bar to be embedded onto the foot 10*b* of the T-shaped rail 10. Both side bars 2 and 3 are connected to one another by a separable temporary bridge P, being intended to be cut when the finishing assembly is being arranged on the floor.

Figure 29:
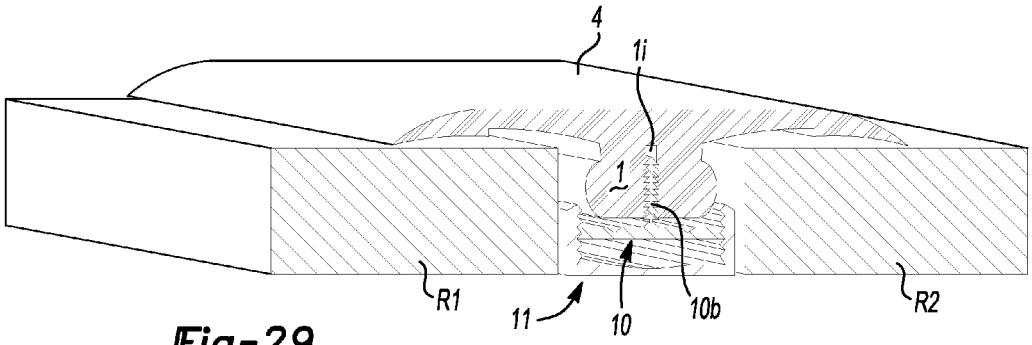

FIG. 29 shows the finishing assembly of FIG. 27 configured as a joint bar and used for a transition between both floor coverings R1 and R2. In such an application, the finishing assembly is fixed to the floor using two rails 10 and 11 one embedded into the other, the groove 1*i* of the T-shaped central bar 1 being embedded into the T-shaped fixing rail 10, and the rail 11 being fixed using any other means (gluing, screwing, . . . ).

Figure 30:
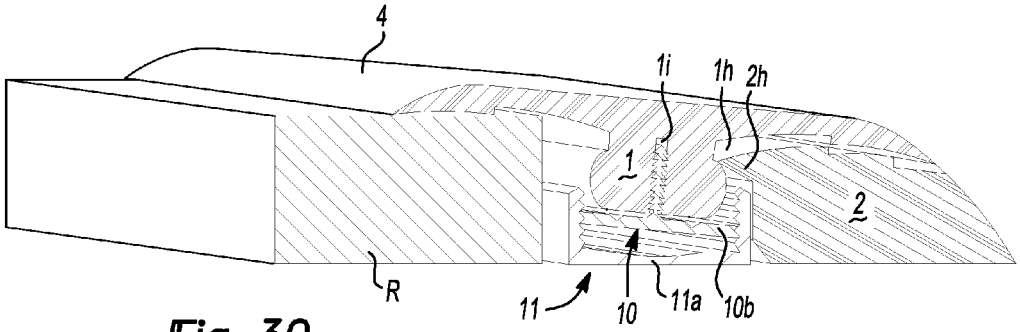

FIG. 30 shows the finishing assembly of FIG. 27 configured as a transition bar and used for a transition between a floor covering R and the floor, said finishing assembly being fixed to the floor by means of both embedded rails 10 and 11. In such an application, the bars 1 and 2 are spaced apart from one another in a plane parallel to their cross-sections, the base

10*a* of the T-shaped rail 10 being tilted relative to the base 11*a* of the U-shaped rail 11. Similarly to the application on FIG. 26, such a tilting is achievable by means of some play existing between the groove 1*h* and the projecting part 2*h* of the bar 2, said play allows the bar 2 to be moved relative to the bar 1, in a plane parallel to the cross-section of the bars.

Figure 31:
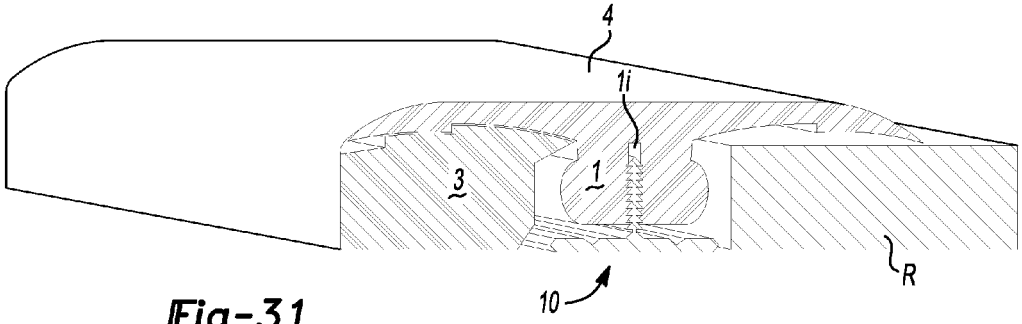

FIG. 31 illustrates the finishing assembly of FIG. 27 configured as a stop bar and used for a transition between a floor covering R and the floor, said finishing assembly being fixed to the floor by means of the T-shaped fixing rail 10 only.

Figure 32:
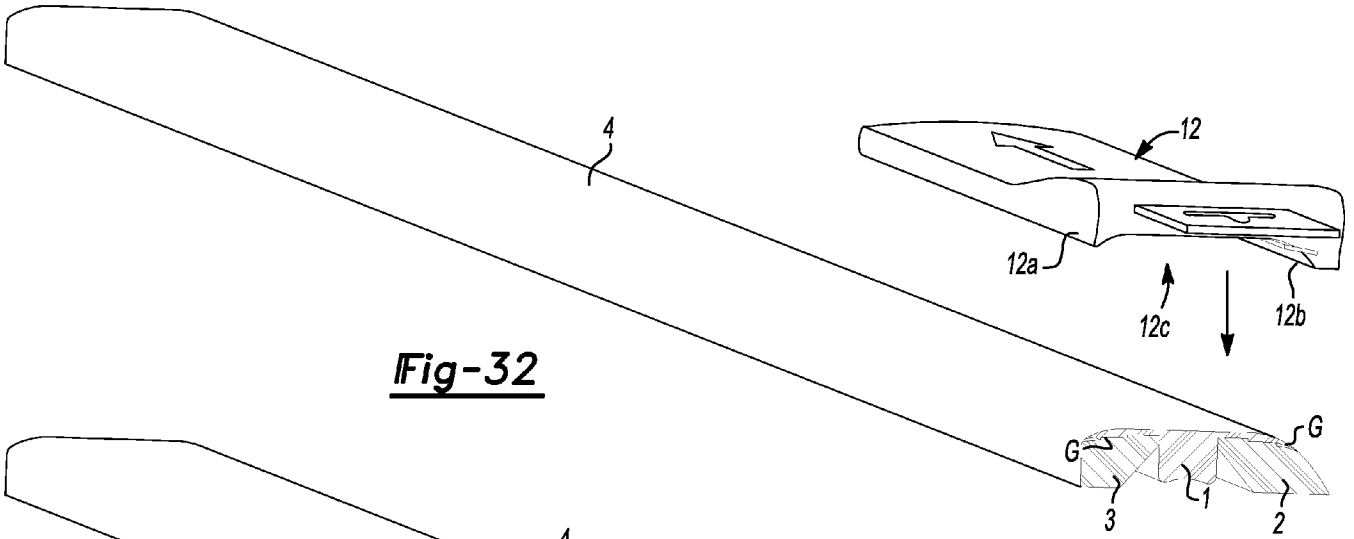
FIG. 32 is a perspective view of a seventh alternative embodiment of a multifunction finishing assembly (joint bar/transition bar/stop bar) and of a tool for cutting the surface coating.

There is shown on FIG. 32 a seventh alternative embodiment of a multifunction finishing assembly (1, 2, 3, 4) according to the invention and a cutting tool 12. Fixing to the floor of such a finishing assembly occurs by means for example of at least one fixing rail (not shown on FIG. 32) into which is embedded the foot of the central bar 1, similarly to what has been previously described for the six other alternative embodiments on FIGS. 1 to 31.

The cutting tool 12 comprises a shoe 12*a* and a cutting blade 12*b* integral with said shoe 12*a*. The foot 12 is for example a plastic moulded part. The shoe 12*a* comprises a face 12*c* (referred to as the bottom face) having a U-shaped recess shape. Said bottom face 12*c* allows the shoe to be positioned on the finishing assembly (1, 2, 3, 4) and said shoe 12*a* to be guided in translation by both side bars 2 and 3 along the longitudinal axis of the finishing assembly. The cutting blade 12*b* is positioned and oriented relative to the shoe 12*a*, such that once the shoe 12*a* being positioned on the finishing assembly (1, 2, 3, 4), the cutting blade 12*b* penetrates into one of the longitudinal grooves G of the finishing assembly.

Figure 33:
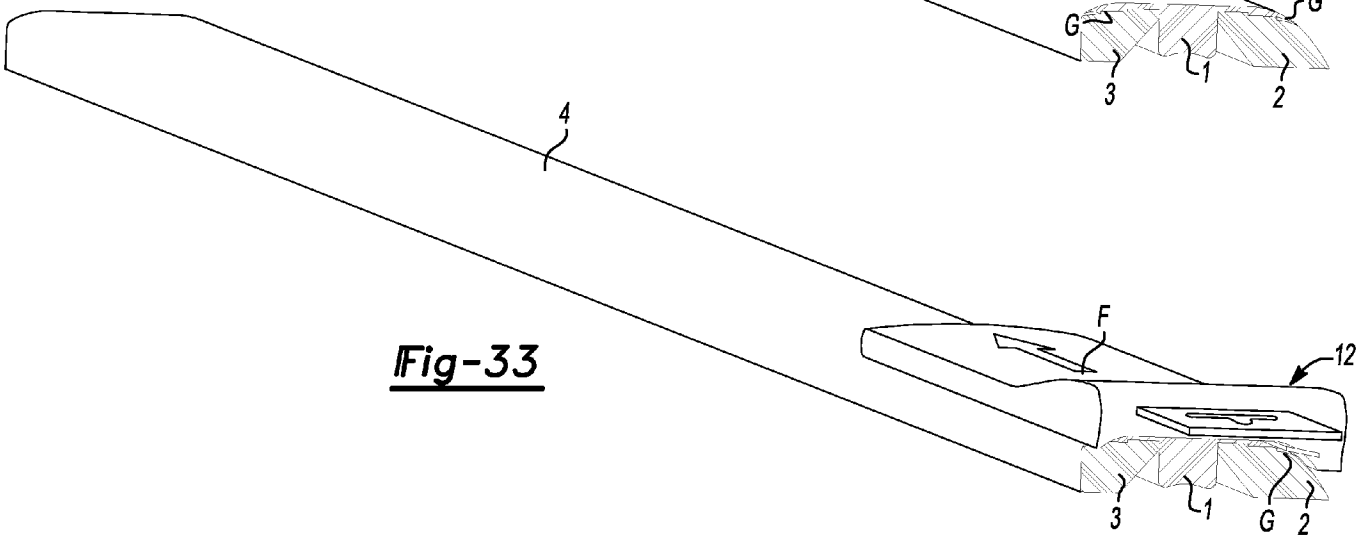
FIG. 33 shows the cutting tool in a cutting position on the finishing assembly shown on FIG. 32.

There is shown on FIG. 33 the cutting tool 12 positioned on the end of the finishing assembly shown on FIG. 32. The cutting blade 12*b* partially penetrates into the longitudinal groove G between the central bar 1 and the side bar 2. By sliding the tool 12 along the finishing assembly (arrow F), the surface coating 4 is very easily and very accurately cut along said longitudinal groove G, allowing to separate the section 2 from the central section 1. For separating, as required, the other section 3 from the central section 1, it is sufficient to reverse the positioning of the cutting tool 12, so that the cutting blade 12*b* penetrates into the longitudinal groove G between the central blade 1 and the side bar 3.

A similar cutting tool could be used for cutting the surface coating 4 of the other previously described alternative embodiments of finishing assembly.

The present invention is not limited to manufacturing a multifunction assembly comprising three bars 1, 2 and 3, but could be generalized so as to achieve a multifunction finishing assembly comprising at least two bars, onto which is applied the same surface coating. For example, a multifunction assembly could be achieved only comprising one T-shaped bar 1 and one bar 2 and usable as a joint bar or a transition bar as well as a multifunction assembly comprising only one T-shaped bar 1 and one bar 3, and usable as a joint bar or a stop bar.

In addition, the cross-sections of the bars of the finishing assemblies of the appended figures were given only by way of non exhaustive examples of embodiments, the invention being not limited to these only sections. The invention could be equally applied for achieving multifunction finishing assemblies for floor covering having their bars with cross-sections different from those illustrated on the appended figures. Moreover, the bars of the finishing assembly of the invention, depending on their cross-sections, could, as required, fulfil other functions than the functions illustrated on the figures (joint bar, transition bar or stop bar). Within the scope of the invention, a finishing assembly could be achieved for a floor covering being able to be used in other applications for floor covering, and for example, that could be configured for a use as a step ridge.

The invention claimed is:

1. A finishing assembly having a longitudinal axis for a floor covering comprising: at least two bars that each include a corresponding surface, said at least two bars being assembled together side by side such that said corresponding surfaces are spaced apart from each other to cooperatively define a groove with an opening therebetween, said groove extending along said longitudinal axis, said at least two bars being assembled to be used in a first floor covering application and said at least two bars being separable such that at least one of said bars is usable in a second floor covering application, said finishing assembly further comprising a surface coating that is applied externally to each of said at least two bars to extend directly over and cover the opening, wherein the groove and opening has a width sufficient for a cutting blade to penetrate through said surface coating and moved through said opening, into said groove, and along said longitudinal axis.

2. The assembly according to claim 1, wherein said at least two bars have cross-sections that are different.

3. The finishing assembly according to claim 1, wherein said at least two bars comprises three bars having different cross-sections, the surface coating applied on each of said three bars.

4. The finishing assembly according to claim 1, wherein said first and second floor covering applications are chosen from a group consisting of a joint bar application, a transition bar application, and a stop bar application.

5. The finishing assembly according to claim 1, wherein one of the at least two bars is a T-shaped bar with a T-shaped cross-section and another of the at least two bars is a side bar that is juxtaposed to said T-shaped bar, said side bar abutting against the T-shaped bar.

6. The assembly according to claim 5, wherein a longitudinal space is arranged between a foot of the T-shaped bar and the side bar, said space being able to serve as a housing for a part of a means for fixing to the floor the T-shaped bar.

7. The assembly according to claim 5, wherein the side bar and the T-shaped bar are assembled allowing for a slight motion of the bars one relative to the other in a plane parallel to their cross-sections.

8. The assembly according to claim 5, wherein at least one wing of the T-shaped bar comprises in a bottom face a blocking longitudinal groove and the side bar comprises a projecting longitudinal part positioned in said blocking longitudinal groove so as to block the side bar relative to the T-shaped bar.

9. The assembly according to claim 5, wherein at least one side face of a foot of the T-shaped bar comprises one blocking longitudinal groove and the side bar comprises a projecting longitudinal part being provided in said blocking longitudinal groove so as to block the side bar relative to the T-shaped bar.

10. The assembly according to claim 8, wherein the projecting longitudinal part and the blocking longitudinal groove are assembled allowing for a slight motion so as to allow for movement of the side bar relative to the T-shaped bar in a plane parallel to the cross-section.

11. The assembly according to claim 1, wherein said at least two bars comprises a central bar having a T-shaped cross-section and two side bars positioned on opposite sides of a foot of the central bar.

12. The assembly according to claim 11, further comprising a pedestal being integral with both side bars, allowing both side bars to be maintained relative to the central bar and which can be separated from both side bars.

13. The assembly according to claim 12, wherein the pedestal comprises a fixing rail able to receive a foot of the T-shaped central bar.

14. The assembly according to claim 12, wherein each side bar comprises a bottom longitudinal groove ensuring the respective side bar to be retained to the floor, the pedestal including two side wings that are separable therefrom, each of the two side wings comprising a longitudinal retaining stud able to be embedded into a respective one of said bottom longitudinal grooves.

15. The assembly according to claim 11, wherein both side bars are connected to one another by bridge, and preferably by a separable bridge.

16. The assembly according to claim 11, wherein both side bars are integrally part of a monobloc assembly and are separable from said assembly.

17. The finishing assembly of claim 1, wherein the width of the groove and opening is greater than 0.6 mm.

18. The finishing assembly of claim 1, wherein one of the corresponding surfaces comprises a longitudinal recessed surface that faces the other of the corresponding surfaces, said groove being delimited by said recessed surface and the other of the corresponding surfaces.

* * * * *